United States Patent [19]

Manns

[11] 4,160,310

[45] * Jul. 10, 1979

[54] METAL-DIELECTRIC ELECTRON BEAM SCANNING STACK

[75] Inventor: William G. Manns, Dallas, Tex.

[73] Assignee: Texas Instruments Incorporated, Dallas, Tex.

[ * ] Notice: The portion of the term of this patent subsequent to Jan. 23, 1996, has been disclaimed.

[21] Appl. No.: 746,910

[22] Filed: Dec. 2, 1976

[51] Int. Cl.[2] ..... H01J 9/02

[52] U.S. Cl. ..... 29/25.14; 29/25.13; 156/309

[58] Field of Search ..... 313/411; 29/25.16, 25.14, 29/25.13, 592 E; 156/309

[56] References Cited

U.S. PATENT DOCUMENTS

| | | | |
|---|---|---|---|
| 2,646,521 | 7/1953 | Rajchman | 313/470 X |
| 3,458,745 | 7/1969 | Shoulders | 313/348 X |
| 3,680,184 | 8/1972 | Greene | 29/25.14 |
| 3,922,577 | 11/1975 | Orthuber | 313/495 X |
| 3,936,697 | 2/1976 | Scott | 313/495 X |

*Primary Examiner*—Richard B. Lazarus

*Attorney, Agent, or Firm*—Gary C. Honeycutt; James T. Comfort; Rene E. Grossman

[57] ABSTRACT

A metal-dielectric electron beam scanning stack and method for making the same is disclosed. The electron beam scanning stack subassembly is fabricated from a series of metal plates, each having a plurality of apertures defined therein at least one plate comprising a spacer plate. Individual apertures are aligned with corresponding apertures of all other plates to form a plurality of electron beam channels. These plates are electrically isolated from and bonded together by spacer plates coated with dielectric material. By etching isolation channels in a selected pattern in these plates, control plates are fabricated having a plurality of isolated conductive portions arranged in selected patterns. Subassemblies are bonded together using either dielectric material or dielectrically coated metal spacer plates having a plurality of correspondingly aligned apertures. Contact leads from the plurality of isolated conductive portions are isolation etched into the inactive peripheral area of the plate. These leads extend along the periphery of the plate where they terminate in the form of multiple contact means protruding from the edge of the plate.

8 Claims, 13 Drawing Figures

METAL-DIELECTRIC ELECTRON BEAM SCANNING STACK

BACKGROUND OF THE INVENTION

The present invention relates in general to an electron beam scanning device and more particularly to a metal-dielectric electron beam scanning stack and method for making the same.

Present flat tube displays are fabricated from glass switching plates and glass spacer plates. Each plate is provided with a matrix of apertures therein fabricated by a chemical etching technique. In fabricating a matrix of apertures in the glass plates, etching masks of precious metals, for example, platinum, gold and titanium are employed to protect selected planar surfaces of the glass plates from the etchant solutions. Upon completion of the etch process, these precious metals are stripped and recovered by standard refining techniques.

The switching plates are coated on both sides and through the aperture holes with a metallized thin-film employing standard techniques. This metallized thin-film is patterned into an appropriate switching matrix using either a conventional photolithographic metal-etching technique or standard photoresist lift-off techniques.

Gold ribbon leads are reflow solder bonded to metallized bonding pads located on each of the switching plates corresponding to each switching matrix pattern. The glass spacer plates are coated with solder glass-frit and the plates assembled into a switching stack array using a thermal solder glass-frit firing cycle and aperture alignment fixtures. These switching stacks thereby comprise alternate layers of glass switching plates and glass insulating plates. The matrix array of aligned apertures in the glass plates provide electron beam channels to the phosphor coated screen. The gold leads are bonded to a mounting plate during tube assembly providing for the external electronic circuit connections.

These glass stacks are mechanically fragile, expensive to fabricate and are frequently broken by thermal stresses during fabrication and operation. In addition, dangerous chemical etching systems used for the glass etching require very expensive processing equipment for adequate operating safety. As noted above, the glass etching process requires expensive precious metal masking in addition to the standard photoresist masking. The low thermal conductivity of the glass switching plates and spacers results in excessive stack heating during high stack input currents that are required for high brightness displays. Finally, thin-film metal deposition processes require vacuum metal applications that increase costs due to the use of multiple vacuum process steps. Other nonvacuum deposition processes have not been successfully demonstrated for switching stack fabrication.

SUMMARY OF THE INVENTION

A metal-dielectric electron beam scanning stack and method for making the same is described. The electron beam scanning stack subassembly is fabricated from a series of metal plates each having a plurality of apertures defined therein at least one plate comprising a spacer plate. Individual apertures are aligned with corresponding apertures of all other plates to form a plurality of electron beam channels therein. These plates are electrically isolated from and bonded together by a spacer plate coated with dielectric material. By etching isolation channels in a selected pattern in these plates, control plates are fabricated having a plurality of isolated conductor portions arranged in preselected patterns. Subassemblies are bonded together using dielectric material or dielectrically coated metal spacer plates having a plurality of correspondingly aligned apertures. Contact leads from the plurality of isolated conductor portions are isolation etched into the inactive peripheral area of the plate. These leads extend along the periphery of the plate where they terminate in the form of multiple contact tabs protruding from the edge of the plate.

The metal-frit laminated stack is made from inexpensive materials using high yield processes. Relatively small losses occur due to breakage during stack fabrication. Because of the improved thermal conductivity as compared to the glass plates of the prior art, the stack can be operated at much higher input current levels without stack distortion or destruction. Metal leads can be fabricated as an integral part of the switching stack. This eliminates anywhere from 100 to more than 500 wire bonds per tube depending on the tube resolution. This method is well suited to high resolution products as well as low resolution displays.

Accordingly, an object of the present invention is to provide a method for the fabrication of a metal-dielectric electron beam scanning stack.

Another object of the invention is to provide a fabrication technique which reduces the number of individually bonded stack leads.

Yet another object of the present invention is to provide an electron beam switching device that can operate at much higher current input to the input buffer without danger of stack breakage.

Another object of the present invention is to provide an electron beam scanning device having improved operating characteristics.

Still another object of the present invention is to provide a simpler and more economical fabrication technique for the fabrication of electron beam switching devices.

BRIEF DESCRIPTION OF THE DRAWINGS

The invention, together with its various features and advantages, can be easily understood from the following, more detailed description taken in conjunction with the accompanying drawings in which.

FIGS. **4–5*a*,5*b*** are sectional views of a portion of a metal plate showing progressive steps in the fabrication of a metal switching plate according to the process of the invention.

Figure 6:
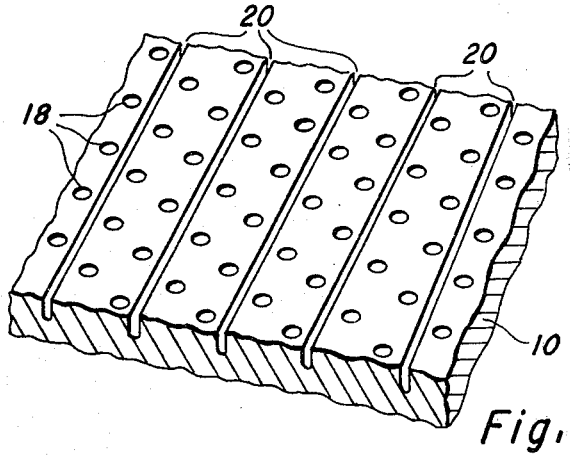

FIG. 6 is a top view of a switching plate showing isolation grooves and finger patterns fabricated according to the present invention.

Figure 7:
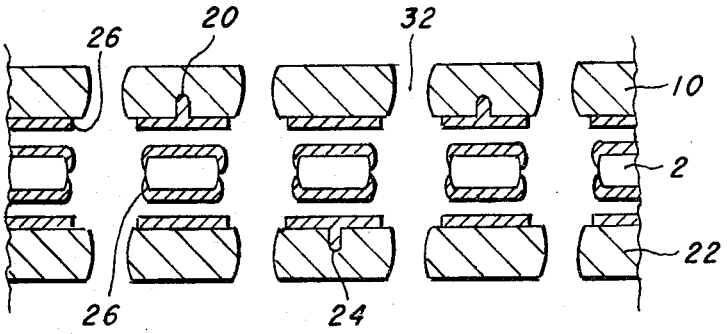
Figure 8:
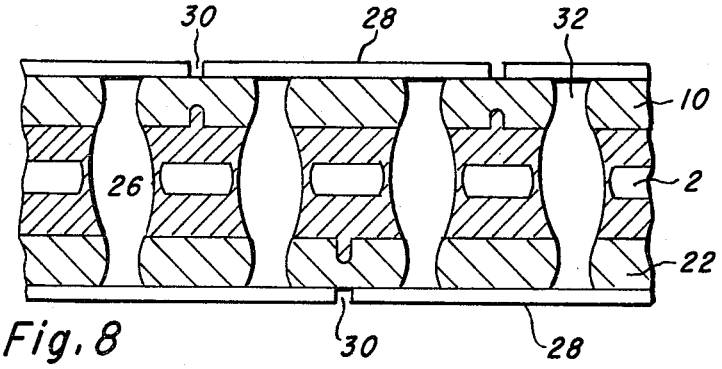
Figure 9:
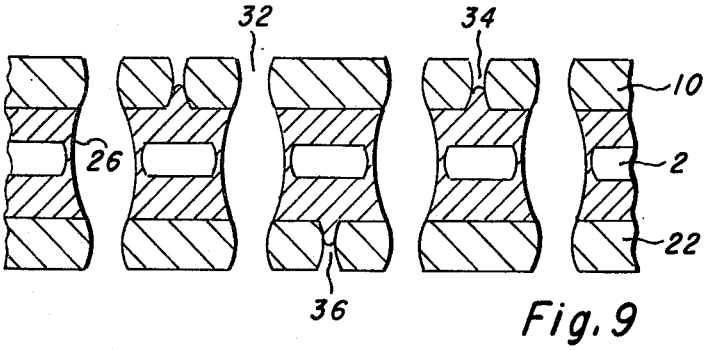

FIGS. 7–9 are sectional views of a portion of a subassembly showing progressive steps in the fabrication of an electron beam scanning device according to the process of the invention.

Figure 10:
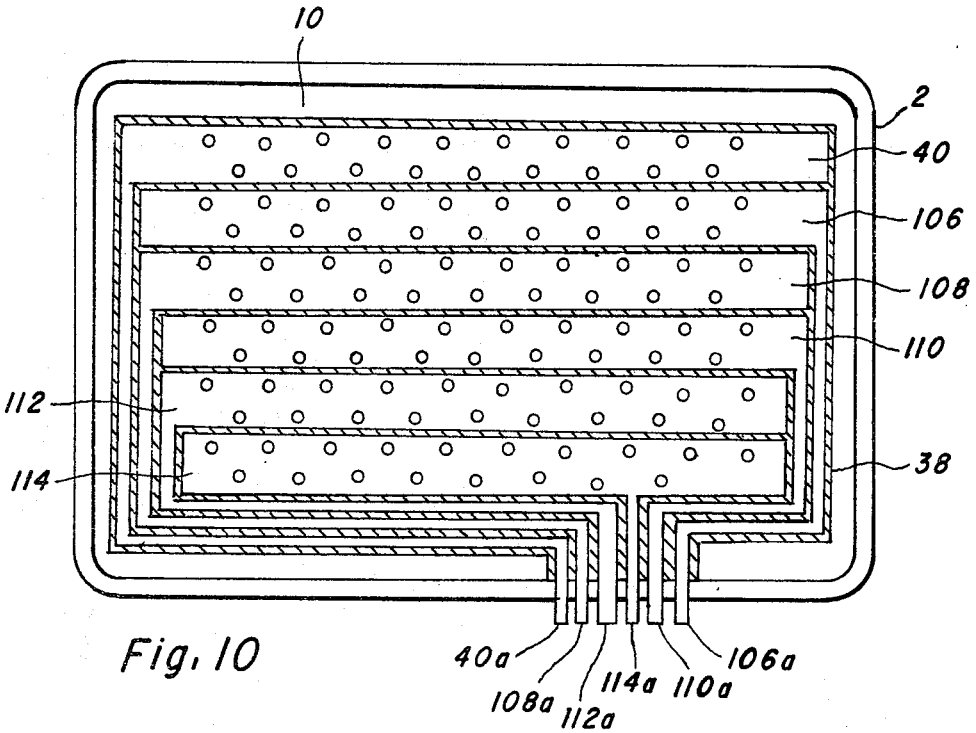

FIG. 10 is a front view of a completed subassembly showing a switching plate fabricated according to the process of the invention.

Figure 11:
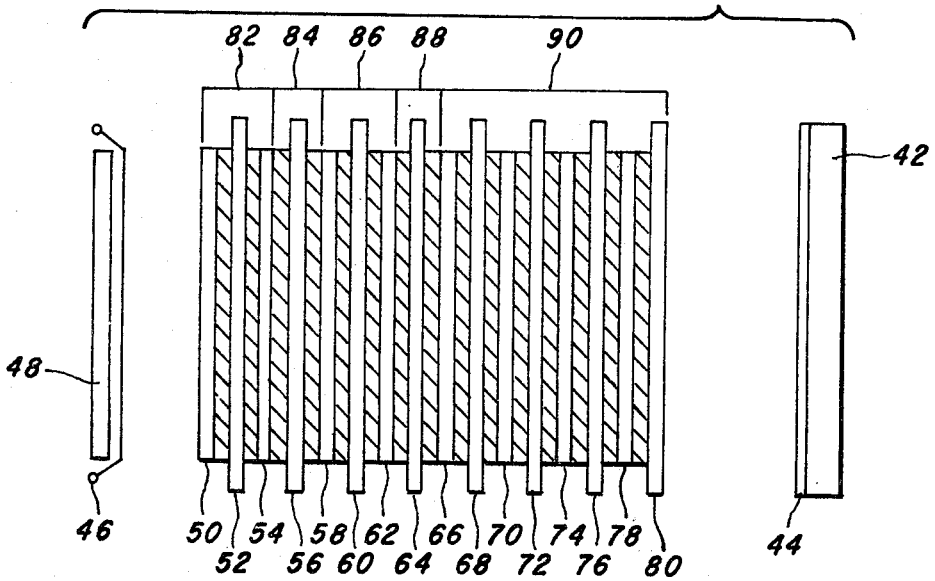
Figure 12:
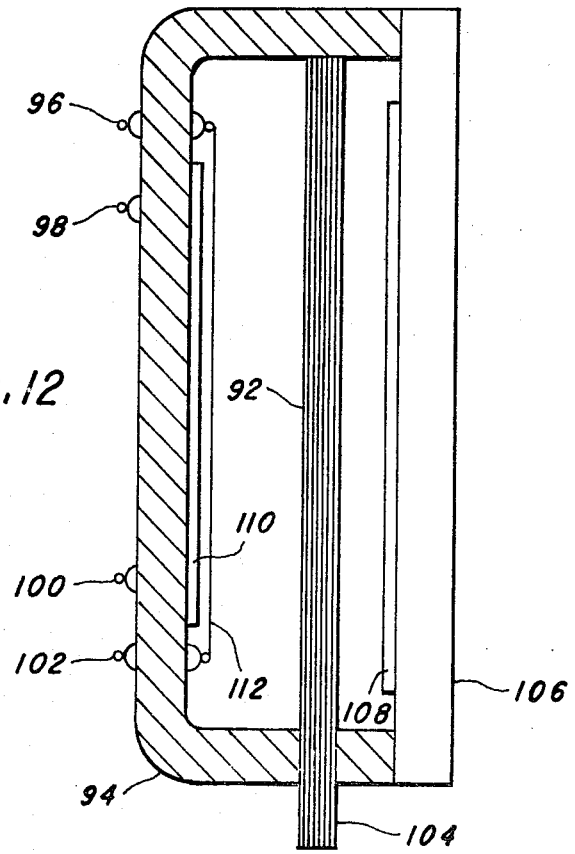

FIGS. 11–12 are sectional views of an electron beam scanning device fabricated according to the process of the present invention.

DETAILED DESCRIPTION

Prior to the fabrication of the electron beam scanning stack by the method of the present invention, the metal sheets are chemically cleaned and dimensionally stabilized. In cleaning the metal sheets, any conventional technique may be utilized. In one method the metal sheets are first degreased by a suitable solvent such as trichloroethylene. The degreased sheets are rinsed in a water spray prior to being etched cleaned in a dilute ferric chloride solution, 39° baume. It is evident to one skilled in the art that other etching compositions may be utilized with the method of the present invention. The precleaned metal sheets are dimensionally stabilized by firing the plates at 975° C. for 15 minutes in a dry hydrogen atmosphere. The hydrogen atmosphere prevents the formation of any surface oxides in addition to reducing any surface oxides already formed thereon. Other reducing atmospheres and firing temperatures may be employed for this dimensional stabilization process.

Figure 1:
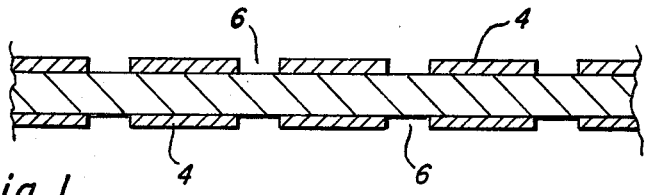
FIGS. 1–2 are sectional views of a portion of a metal plate showing progressive steps in the fabrication of a metal spacer plate according to the process of the invention.
Figure 2:
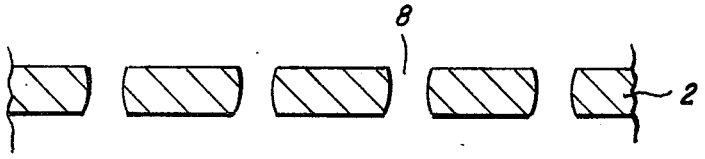
Figure 3:
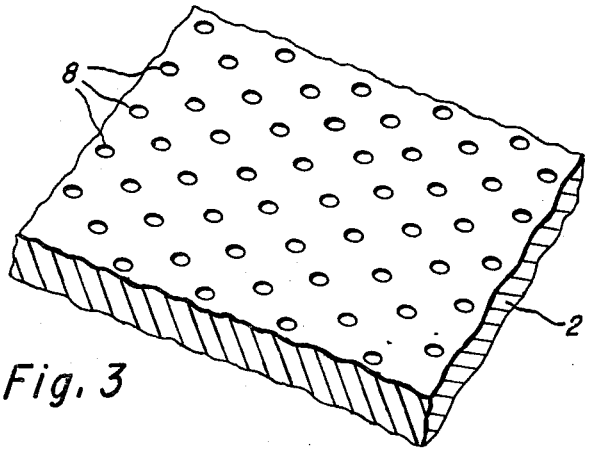
FIG. 3 is a top view showing the arrangement of the aperture matrix fabricated according to the process of the invention.

Referring now to FIGS. 1–3, the method for fabricating metal spacer plates having a preselected matrix of apertures therein is indicated according to the methods of the present invention. A previously cleaned and dimensionally stabilized metal plate 2 is employed. The composition of this metal plate may comprise a variety of alloys.

Particular properties of the metal plate are that it have a high electrical and thermal conductivity, and a thermal coefficient of expansion compatible with the use of the dielectric material used as a sealant and electrical isolation medium. Useful metal alloys may comprise: 42% or 46% nickel with the balance iron, 1008 steel, and Sealmet 1 (28% chrome balance iron). The present embodiment employs an alloy comprising 46% nickel with the balance iron. It is apparent to one skilled in the art that other metal alloys may be used according to the method of the present invention.

The top and bottom planar surfaces of the metal plate are coated with a layer of photoresist 4, for example, AZ135OJ. By using standard photolithographic techniques, the photoresist layers 4 are patterned so as to have mask apertures 6 defining the selected aperture matrix pattern of the completed metal spacer plates. The corresponding apertures 8 are etched through the metal plate 2 by means of a suitable etchant composition. One particular etching composition used under the method of the present invention comprised a mixture of 46° baume ferric chloride and hydrochloric acid. Other etchant compositions or other techniques for producing the aperture holes within the metal plate 2 may be used without departing from the scope of the present invention.

As noted in FIG. 3 the metal plate 2 has a matrix of apertures 8 defined herein in a preselected pattern comprising a hexagonal array. Other preselected matrix patterns may be employed with equal utility. The thickness of the metal plates employed by the method of the present invention is approximately 2 mils. Other thicknesses in the range of about 1–20 mils for the metal spacer plate as well as the other plates of the electron beam scanning device in the present embodiment may be used without departing from the scope of the present invention.

Figure 4:
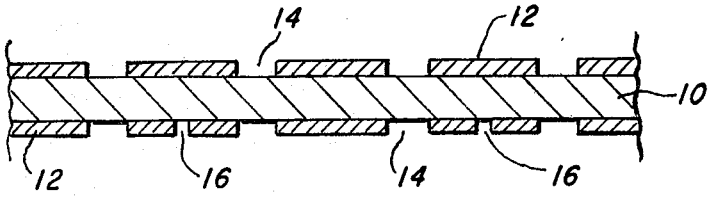
Figure 5A:
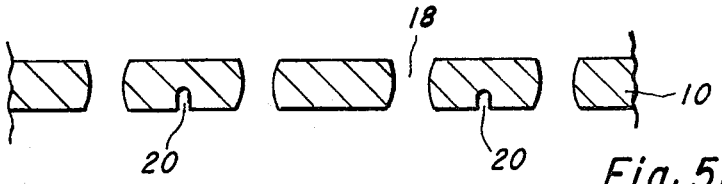
Figure 5B:
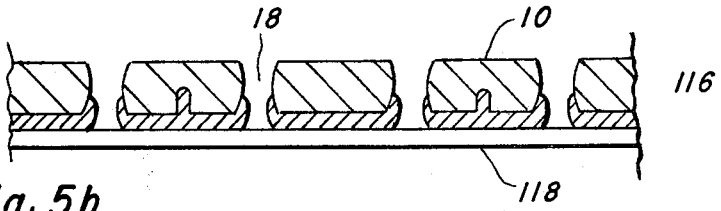

Referring now to FIGS. 4–6 a similar fabrication method is employed in the fabrication of metal plates whose function may be that of switching plates, modulating plates or other operating plates required having separate isolated conductive portions defined therein. Accordingly, a metal plate 10 of approximately 2 mils in thickness is masked on its top and bottom planar surfaces with a suitable photoresist composition 12 as already noted. An aperture matrix pattern is defined in the photoresist layers 12 on both the top and bottom surfaces of the metal plate so as to define the apertures 14 corresponding to the matrix aperture patterns 6 and 8 of the corresponding spacer plate 2. By use of a suitable etching composition or other suitable methods as previously mentioned, the aperture hole matrix 18 is defined in the metal plate 10 corresponding to the aperture hole matrix 8 of the corresponding spacer plate 2.

The diameter of the holes 8 in the spacer plates 2 of FIG. 1 are somewhat larger than the holes 18 of the bonded neighboring plates 10 of FIG. 5*a*. One aspect of the fabrication process of the present invention is that there be a clear free electron path through the metal plate assembly. During the application of vitreous glass frit to the planar surface area of the spacer plates, it is highly likely that glass frit will penetrate into the aperture opening in a manner so as to reduce their effective diameter. To compensate for this effect, the holes are made somewhat larger as noted. In one embodiment the holes are about 24 mils in diameter as opposed to 18 mils in the neighboring plates. If glass frit should obstruct the holes, incoming electrons will subsequently hit the glass frit coating and deposit a negative charge thereon. As this charge builds up, it will effectively shut off that hole by repelling any incoming electrons. This problem is eliminated as noted above. An alternative method for eliminating this problem is to employ a suitable hole cleaning method to remove any glass frit within the apertures or to develop a glass frit application method which will not deposit the material within the apertures.

The metal plate 10 may be utilized for a variety of functions, for example, a buffer plate, a focusing plate, a modulating plate or a switching plate. In this respect the metal plate may be separated into a plurality of separate conductor portions arranged in selected patterns. In one embodiment the bottom layer of photoresist 12 is patterned so as to define isolation channels 16 of the corresponding conductive pattern. The etched groove pattern 20 is fabricated during the same etching operation that defines the matrix of hole apertures 18 in the same metal plate as indicated by FIGS. 4 and 5. As indicated in FIG. 6 this sequence of etching and masking operations provides a metal plate 10 having a matrix of apertures 18 defined therein partially separated into separate isolated conductive portions by an etched groove 20.

The isolated conductive portions can be fabricated into a variety of geometric patterns that will have utility within an electron beam switching stack. Accordingly, such isolated conductive portions may be patterned in the form of fingers, interdigitated fingers, serpentines, strips, bars, graphic shapes, dynodes and trinodes. Other selected patterns of the type described will also have utility with the method of the present invention.

In another embodiment (not shown) the separate isolated conductive portions may be fabricated after completion of the subassembly. In this respect the metal plate 10 is bonded to the spacer plate 2 so as to provide a support for the separate isolated conductive portions. The selected pattern is patterned onto the exposed planar surface of the metal plates 10 allowing for the complete etching through the plate of the isolation grooves as noted in the above embodiment. In this regard etching the isolation grooves is achieved in a one-step process from one side of the metal plate only.

In reference to the first embodiment the metal plate 10 having the partial isolation grooves 20 defined therein is bonded to the metal spacer plate 2. Similarly, a third metal plate 2 also having a plurality of apertures defined therein is fabricated according to the technique previously described. This plate may also have the isolation grooves for the corresponding isolated conductive patterns where the plate is to be utilized for modulating or switching. The three plates are bonded together using dielectric material so as to align their corresponding apertures and to provide a matrix of electron beam channels therein.

One type of dielectric material used in the present embodiment is vitreous glass-frit. However, the method of the present invention may be practiced by using other types of dielectric material, for example, porcelain enamels, solder glass-frits, ceramic pastes, and crushed mica.

In bonding the three plates together to provide a subassembly, the spacer plate 2 is coated with vitreous glass-frit over the planar surface area so as to provide electrical insulation 26 with the neighboring bonded metal plates 10 and 22. In one embodiment as indicated in FIG. 7, the metal plates 10 and 22 are bonded to the spacer plate by coating one surface with a layer of vitreous glass-frit 26. The total combined thickness of the vitreous glass-frit layer 26 results in an electrical isolation layer of approximately 2 mils having a useful range of about 1–10 mils. As indicated in FIG. 7, the vitreous glass-frit layer fills into the isolation groove 20 of the isolated conductive pattern. In an alternative method a heavier deposit of vitreous glass-frit on the spacer plate may be used so as to eliminate the process step of applying a vitreous glass-frit layer to the neighboring metal plates 10 and 22.

As noted above, it is desired that the apertures remain unobstructed by excess glass-frit. A method of eliminating this problem on metal plates having a glass-frit coating on one surface is by an "etch-back" process as indicated in FIG. **5*b*. The dielectric material 116 upon application to the planar surface of the metal plate 10, partially extends into the apertures 18. To selectively remove this material, a mask layer 118 is deposited over the entire planar surface of the metal plate so as to block off the apertures therein. This mask material does not have to be photosensitive, only that it be chemically inert to the etching chemical being used. In one embodiment, hydrofluoric acid on a mixture of hydrofluoric acid and hydrochloric acid is used. The metal plate is dipped in the etching solution for a sufficient deviation, so as to "etch-back" the glass-frit resulting in an unobstructed aperture as indicated in plates 2 and 10 of FIGS. 7, 8, and 9. In the alternative, the assembled subassembly as indicated in FIG. 9** may be dipped in the etching solution to etch the apertures free of any glass-frit and produce the "etch-back" profile.

In the embodiment wherein the isolation grooves are partially etched into the metal plate, it is necessary to complete the isolation step by etching through the metal plate completely from the opposite side. FIGS. 8–9 represent the final steps required for the completion of a completed subassembly comprising a spacer plate and two bonded neighboring plates. However, a subassembly may comprise only a spacer plate and one neighboring plate, as will become evident in the method used to bond the spacer plates together in providing for a completed electron beam scanning stack. After the subassembly plates are laminated together, one or both of the outside plates is patterned using a dry film photoresist layer 28. The photoresist layer is patterned so as to expose the isolation channels 30 corresponding to the already partially etched isolation grooves 20 and 24. In the manner described above, the isolation grooves are etched through the plates so as to define the isolation grooves 34 and 36 as indicated in FIG. 9. The photoresist employed blocks the electron beam holes 32 in the substrate, thus preventing etchant contamination of the vitreous glass-frit in areas that will be exposed to an electron beam. This minimizes out-gassing and cathode poisoning. It also eliminates further etching of the hole diameter.

FIG. 9 indicates a completed three-plate subassembly. The subassembly comprises a plurality of electron beam apertures 32 defined in a matrix pattern. The plate 2 acts as an isolation spacer plate for the neighboring plates 10 and 22 which may have the functions of switching, modulating, focusing or buffering. The vitreous glass-frit layer 26 is the medium used to bond the plates together to form the subassembly as well as to provide the electrical isolation. The outside plates have isolated separate conductive portions defining the activated electron areas. These isolated separate conductive portions are isolated by means of the isolation grooves 34 and 36. As noted above, a subassembly may comprise only a spacer plate 2 and one additionally bonded plate 10 or 22. This depends upon the function of the subassembly desired, the design of the switching stack, or the desires of the design engineer.

A front view of a completed subassembly is indicated in FIG. 10. The dimensions of the spacer plate 2 is such that it extends beyond the peripheral edge of the switching plate 10 in order to provide an isolation barrier between the opposite control plates to prevent shorting across the spacer plate. As indicated, the subassembly has a matrix of apertures 32 defined therein. These apertures are arranged so as to constitute isolated separate conductive portions 40, 106, 108, 110, 112, and 114. These conductive portions are isolated from each other by means of the isolation grooves provided for during the manufacture of the subassembly. One such isolation groove 38 is indicated in FIG. 10. These isolation grooves may define a preselected pattern of apertures for selective activation as desired. Any number of holes may be grouped in any desired pattern. For example, columns or rows may be provided for any geometric pattern that would have utility for the desired electron beam scanning stack.

It is not required that each subassembly have provided isolated conductive portions. For example, a focusing subassembly will usually not have any isolated conductive portions. In addition, in certain types of flat tube displays it is possible for the entire stack to be void of isolated conductive portions. These electron beam stacks can still be fabricated by the method of the present invention by elimination of the isolation step.

Each isolated conductive portion must be provided with a contact means. These conductive contact leads are fabricated into the metal plates containing the isolated separate conductive portion by the same fabrication method and during the same sequence of events that defines the separate conductive portions therein. In this regard, the contact leads from the separate conductive portions are isolation etched into the inactive peripheral area of the control plate. These contact leads extend along the periphery of the plates where they terminate in the form of multiple contact tabs protruding from the edge of the plate. These contact tabs are represented by FIGS. 40*a*, 108*a*, 106*a*, 110*a*, 112*a*, and 114*a*. These contact tabs may now be used for providing the necessary leads to connect the individual isolated conductive portions with the electronic circuitry of the electron beam scanning stack. These leads may be fabricated long enough in one embodiment to actually protrude through the external wall of the flat tube display case and therefore provide a convenient contact means. In another embodiment, the contact tabs remain within the flat tube display case so as to be internal contact means. These contact tabs and contact leads may be arranged in other patterns not indicated in FIG. 10 and not depart from the scope of the present invention.

As indicated above, subassemblies may comprise either two- or three-plate assemblies. These subassemblies are bonded together by vitreous glass-frit without the use of spacer plates or with spacer plates that have been coated with vitreous glass-frit. These subassemblies are arranged to provide a switching stack array using a thermal vitreous glass-frit firing cycle and aperture alignment fixtures to produce a completed electron beam scanning stack having a matrix of electron beam channels therein.

It is clear to one skilled in the art that any number of two-plate or three-plate subassemblies may be assembled together to fabricate the completed electron beam scanning stack. In addition, each two-plate or three-plate subassembly may be fabricated so as to have any desired function such as switching or modulating. There is no limit to the complexity of the subassemblies or to the functions that may be achieved with them. In addition, the combination of the subassemblies in terms of number and function may be infinite only limited by the expertise of the user.

The electron beam scanning stack fabricated according to the method of the present invention has a variety of advantages over prior art methods. For example, no glass parts are to be fabricated or utilized which would constitute a source of breakage. Hole etching and lead etching processes are separate; this inherently allows for better control of the hole size independent of line separation. The electrical conductive portions of the stack are made from thicker materials rather than evaporated thin films which correspondingly results in lower lead resistance in addition to more rugged leads, making it easier to burn out those shorts that may be present. This method also eliminates the need for extremely hazardous chemical processes that are required for the etching of glass plates. Thinnner stacks having substantially improved electron transmission can be fabricated which results in much brighter display pictures. The need for precious metals in the fabrication of stacks is eliminated therefore reducing processing costs. Stacks fabricated by the method of this invention can be operated at much higher current input to the input buffer without danger of stack breakage. With the use of heavy leads or tabs etched as part of the input buffer, thermal stresses can be greatly reduced.

In addition, electrical leads are etched as part of the plate fabrication process. These leads can be used directly as part of a connector assembly, thus eliminating completely the wire bonding process to the switching stack. This is important because a typical electron beam scanning stack can have several hundred stack leads which require two wire bonds in each of the conventional stacks.

FIG. 11 indicates a completed electron beam scanning stack fabricated according to the method of the present invention. A viewing screen 42 is provided with a phosphor surface 44 as a target area. An electron source 46 is provided with a field shaping plate 48 therebehind. In between the electron source and the phosphor screen is inserted a plurality of metal plates ccomprising an electron beam scanning stack fabricated according to the method of the present invention.

Glass-frit is represented by the hatched areas. Section 82 represents a three-plate subassembly comprising plates 50, 52, and 54 which respectively represent a segmented input buffer, a dielectrically coated spacer plate, and a switching plate fabricated according to the method of the present invention. Section 86 represents a second subassembly comprising also of three plates 58, 60, and 62, which represent respectively a modulating plate, a glass-frit coated spacer plate, and a switching plate. The two subassemblies are bonded together by means of a glass-frit coated spacer plate 56 represented as section 84. A focusing subassembly is represented by section 90 comprising plates 66, 68, 70, 72, 74, 76, 78, and 80. These plates are alternating buffer plates and spacer plates. Focusing assembly acts to focus the switched electrons to respective target areas on the phosphor coating 44. The switching subassemblies are bonded to the focusing subassembly by glass-frit coated spacer plate 64 represented by section 88. It is relatively apparent to one skilled in the art that the subassemblies may comprise two-plate subassemblies or three-plate subassemblies, each subassembly having any desired function, and any number of subassemblies may be bonded together to form an electron beam scanning stack. The electron beam scanning stack represented by FIG. 11 is only one possible embodiment using the method of the present invention.

The focusing subassembly 90 is shown fabricated from eight metal plates. This subassembly can be fabricated as one single eight-plate unit as opposed to three-plate subassemblies bonded together by means of a glass-frit coated spacer plate. In addition, the focusing subassembly may be fabricated from four, two-plate subassemblies bonded together by glass-frit without the use of a spacer plate FIG. 12 indicates a completed electron beam scanning system such as a flat tube display. A viewing screen 106 is provided with a phosphor target 108. An electron beam source 112 has two external electrodes 96 and 102. Electrons are directed towards the switching stack 92 by means of plate 110 having electrodes 98 and 100. The electron beam switching stack 92 has a plurality of contact leads 104 extending through the flat tube displays case 94. This FIG. 12 of a flat tube display is highly simplified and is only intended to indicate the utility for the electron beam scanning stack fabricated by the method of the present invention. An electron beam scanning stack fabricated by the method of the present invention may be employed in other more complicated systems that require the need for switching and modulating electrons in a preselected manner in addition to other operating functions.

Other applications for the methods of the present invention include metal laminated structures to be used in place of conventional copper-plastic multilayer printed circuit boards. It could also be used in other types of matrix address displays such a two- or three-dimensional switching array. In each case the construction would be similar to the present design. For better conduction copper would be used for multilayer circuit boards. Correspondingly, for lower operating voltages a metal with a lower work function would be used for plasma displays.

While particular embodiments of this invention have been disclosed herein, it will be understood that various modifications may become apparent to those skilled in the art without departing from the spirit and scope of the invention which is defined by the appended claims.

What is claimed is:

1. A method of fabricating an electron beam scanning stack comprising the steps of:

fabricating a matrix of apertures in a first and second plurality of metal plates having first and second planar surfaces;

fabricating a groove pattern in said first planar surface of at least two of said first plurality;

coating said first and said second surfaces of one of said second plurality with dielectric material;

aligning said apertures of said first plurality having said groove pattern with said apertures of said one of said second plurality to form a matrix of electron channels therein, said groove pattern of said first plurality being aligned to said first and said second surfaces of said one of said second plurality;

bonding said first plurality having said groove pattern to said one of said second plurality by means of said dielectric material;

fabricating said groove pattern into an isolation channel from said second planar surface of said first plurality, thereby fabricating a subassembly;

coating said first planar surface of at least one of said second plurality with dielectric material;

aligning said apertures of at least two of said second plurality forming a matrix of electron channels therein, at least one of said second plurality having said dielectric coating thereon;

bonding said second aligned plurality together by means of said dielectric material to form a matrix of electron channels therein;

aligning said electron channels of said subassembly with said electron channels of said bonded second plurality; and bonding said bonded second plurality to said second planar surface of said subassembly by means of a layer of dielectric material.

2. A method as set forth in claim 1 further including the step of coating said first surface having said groove pattern with dielectron material.

3. A method as set forth in claim 1 further including the steps of:

fabricating a plurality of said subassemblies;

coating said second planar surface of said subassembly with dielectric material;

aligning the electron channels in said plurality of said subassemblies: and bonding said plurality of said subassemblies together by means of said dielectric material.

4. A method as set forth in claim 3 further including the step of bonding together said plurality of subassemblies by means of a dielectric coated plate of said second plurality having aligned apertures therewith.

5. A method of fabricating an electron beam scanning stack comprising the steps of:

fabricating a matrix of apertures in a first and second plurality of metal plates having first and second planar surfaces;

coating said first and said second surfaces of one of said second plurality with dielectric material;

aligning said apertures of said first plurality with said apertures of said one of said second plurality to form a matrix of electron channels therein, said first plurality being aligned to said first and said second surfaces of said one of said second plurality;

bonding said first plurality to said one of said second plurality by means of said dielectric material;

fabricating into isolation channels said bonded first plurality from said second planar surface of said first plurality, thereby fabricating a subassembly;

coating said first planar surface of at least one of said second plurality with dielectric material;

aligning said apertures of at least two of said second plurality forming a matrix of electron channels therein, at least one of said second plurality having said dielectric coating thereon;

bonding said second aligned plurality together by means of said dielectric material to form a matrix of electron channels therein;

aligning said electron channels of said subassembly with said electron channels of said bonded second plurality; and bonding said bonded second plurality to said second planar surface of said subassembly by means of a layer of dielectric material.

6. A method as set forth in claim 5 further including the steps of:

fabricating a plurality of said subassemblies;

coating said second planar surface of said subassembly with dielectric material;

aligning said electron channels in said plurality of subassemblies; and bonding said plurality of subassemblies together by means of said dielectric material.

7. A method as set forth in claim 6 further including the step of bonding together said plurality of subassemblies by means of a dielectric coated plate of said second plurality having aligned apertures therewith.

8. A method as set forth in claim 7 further including the step of fabricating isolated contact leads in said first plurality.

* * * * *